US009397482B2

(12) United States Patent
Yamanaka

(10) Patent No.: US 9,397,482 B2
(45) Date of Patent: Jul. 19, 2016

(54) SPARK PLUG FOR INTERNAL COMBUSTION ENGINE

(71) Applicant: DENSO CORPORATION, Kariya, Aichi-pref. (JP)

(72) Inventor: Kouji Yamanaka, Nishio (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 14/593,127

(22) Filed: Jan. 9, 2015

(65) Prior Publication Data

US 2015/0194793 A1 Jul. 9, 2015

(30) Foreign Application Priority Data

Jan. 9, 2014 (JP) ..... 2014-002059

(51) Int. Cl.
*H01T 13/20* (2006.01)
*H01T 13/54* (2006.01)
*H01T 13/32* (2006.01)

(52) U.S. Cl.
CPC ..... *H01T 13/54* (2013.01); *H01T 13/32* (2013.01)

(58) Field of Classification Search
CPC ..... H01T 13/00; H01T 13/02; H01T 13/20; H01T 13/06; H01T 13/48; H01T 13/54
USPC ..... 313/118, 123, 132, 137, 139, 141, 142, 313/143
See application file for complete search history.

(56) References Cited

U.S. PATENT DOCUMENTS

| | | | | |
|---|---|---|---|---|
| 4,930,473 | A * | 6/1990 | Dietrich | 123/266 |
| 5,105,780 | A * | 4/1992 | Richardson | 123/263 |
| 5,554,908 | A | 9/1996 | Kuhnert et al. | |
| 5,947,076 | A * | 9/1999 | Srinivasan et al. | 123/267 |
| 7,922,551 | B2 * | 4/2011 | Tozzi | 445/7 |
| 8,104,444 | B2 * | 1/2012 | Schultz | 123/143 B |
| 8,127,741 | B2 * | 3/2012 | Johng et al. | 123/250 |
| 8,181,617 | B2 * | 5/2012 | Kuhnert et al. | 123/143 B |
| 8,324,792 | B2 * | 12/2012 | Maul et al. | 313/141 |
| 8,461,750 | B2 * | 6/2013 | Tozzi | 313/141 |
| 8,536,769 | B2 * | 9/2013 | Kuhnert et al. | 313/140 |
| 8,662,053 | B2 * | 3/2014 | LaPointe et al. | 123/266 |
| 8,915,227 | B2 * | 12/2014 | Johng | 123/169 P |
| 2005/0211217 | A1 * | 9/2005 | Boley et al. | 123/266 |
| 2013/0206122 | A1 * | 8/2013 | Chiera et al. | 123/594 |

FOREIGN PATENT DOCUMENTS

| | | |
|---|---|---|
| JP | 2008-186667 | 8/2008 |
| JP | 2011-214492 | 10/2011 |
| WO | WO 03/071644 | 8/2003 |

* cited by examiner

*Primary Examiner* — Donald Raleigh
*Assistant Examiner* — Kevin Quarterman
(74) *Attorney, Agent, or Firm* — Nixon & Vanderhye P.C.

(57) ABSTRACT

A spark plug for an internal combustion engine includes a tubular housing, a tubular insulator held inside the housing, a center electrode held inside the insulator, a ground electrode disposed so as to form a spark discharge gap with the center electrode, and a plug cover fixed to a distal end portion of the housing so as to form an auxiliary combustion chamber with the housing. The plug cover is formed with at least one through hole for communicating between inside of the auxiliary chamber and outside of the plug cover. The ground electrode is formed so as to project from an inner surface of the plug cover toward the inside of the auxiliary combustion chamber.

1 Claim, 5 Drawing Sheets

SPARK PLUG FOR INTERNAL COMBUSTION ENGINE

This application claims priority to Japanese Patent Application No. 2014-2059 filed on Jan. 9, 2014, the entire contents of which are hereby incorporated by reference.

BACKGROUND OF THE INVENTION

1. Field of the Invention

The present invention relates to a spark plug including an auxiliary combustion chamber around a spark discharge gap for an internal combustion engine.

2. Description of Related Art

There is known a spark plug including an auxiliary combustion chamber around a spark discharge gap for an internal combustion engine of a vehicle, a cogeneration apparatus system and the like. For example, refer to Japanese Patent Application Laid-open No. 2011-214492. Such a spark plug operates to introduce an air-fuel mixture present in a combustion chamber of an internal combustion engine into its auxiliary combustion chamber, and making a spark discharge in a spark discharge gap to ignite the air-fuel mixture to thereby produce a flame in the auxiliary combustion chamber. Thereafter, a flame jet is blown out from the auxiliary combustion chamber to the combustion chamber of the internal combustion engine, as a result of which the flame spreads throughout the entire combustion chamber. Hence, the spark plug described in the above patent document enables providing an internal combustion engine with a high combustion rate.

However, since the ground electrode of the spark plug described in the above patent document is disposed in a housing, the ground electrode lies between the spark discharge gap and the distal end of the auxiliary combustion chamber. Accordingly, since a flame kernel produced in the spark discharge gap is inhibited from growing by the ground electrode, and accordingly inhibited from spreading rapidly in the auxiliary combustion chamber.

SUMMARY

An exemplary embodiment provides a spark plug for an internal combustion engine including:

a tubular housing;

a tubular insulator held inside the housing;

a center electrode held inside the insulator;

a ground electrode disposed so as to form a spark discharge gap with the center electrode; and a plug cover fixed to a distal end portion of the housing so as to form an auxiliary combustion chamber with the housing;

wherein the plug cover is formed with at least one through hole for communicating between inside of the auxiliary chamber and outside of the plug cover, and the ground electrode is formed so as to project from an inner surface of the plug cover toward the inside of the auxiliary combustion chamber.

According to the exemplary embodiment, there is provided a spark plug of the type having an auxiliary combustion chamber, which is capable of improving the combustion rate and combustibility of an internal combustion engine.

Other advantages and features of the invention will become apparent from the following description including the drawings and claims.

PREFERRED EMBODIMENTS OF THE INVENTION

Figure 1:
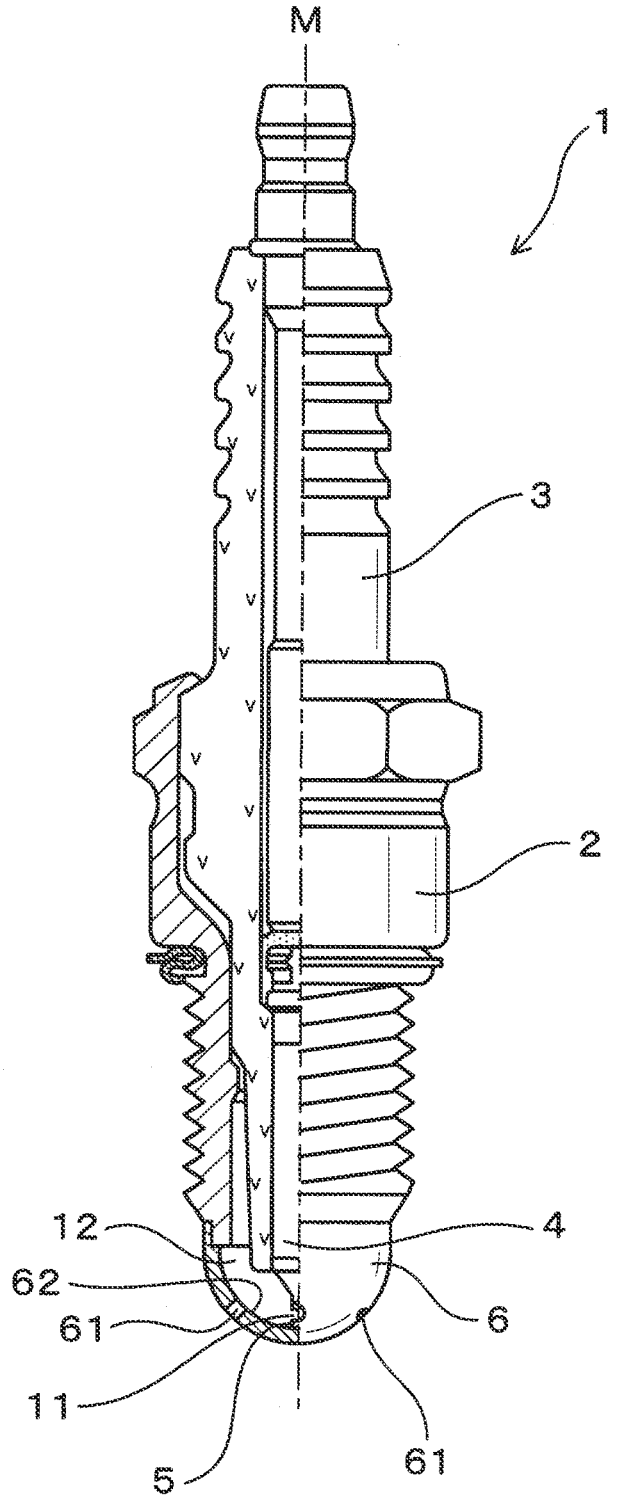
FIG. 1 is a partial cross-sectional view of a spark plug according to a first embodiment of the invention.

In the below-described embodiments of the invention, the same or equivalent parts or portions are indicated by the same reference numerals or characters.

First Embodiment

A spark plug 1 according to a first embodiment of the invention is described with reference to FIGS. 1 to 4. As shown in FIG. 1, the spark plug 1 includes a tubular housing 2, a tubular insulator 3 held inside the housing 2, a center electrode 4 held inside the insulator 3, a ground electrode 5 forming a spark discharge gap 11 with the center electrode 4, and a plug cover 6 fixed to the distal end of the housing 2.

Figure 2:
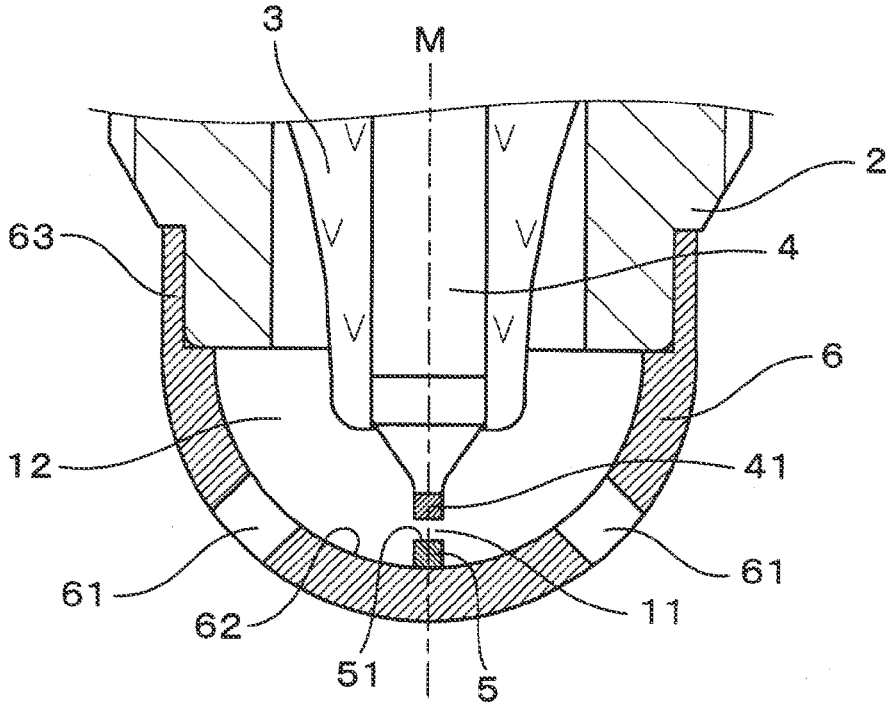
FIG. 2 is a cross-sectional view of a distal end portion of the spark plug according to the first embodiment of the invention.

As shown in FIG. 2, the plug cover 6 defines an auxiliary combustion chamber 12 with the housing 2, the spark discharge gap 11 being located in the auxiliary combustion chamber 12. The plug cover 6 is formed with through holes 61 which communicate the auxiliary combustion chamber 12 with the outside of the plug cover 6. The ground electrode 5 projects from the inner surface 62 of the plug cover 6 toward the auxiliary combustion chamber 12

The plug cover 6 has a hemispherical dome shape, and fixed to the distal end portion of the housing 2 in a state of its open end 63 being directed to the proximal side. The open end 63 of the plug cover 6 is joined to the distal end portion of the housing 2 throughout its circumference by welding or the like.

The ground electrode 5 is disposed at a position on the inner surface 62 of the plug cover 6, the plug center axis M of the spark plug 1 passing through this position. The ground electrode 5 is joined to the plug cover 6 by welding or the like. The ground electrode 5 projects from the inner surface 62 of the plug cover 6 toward the proximal side. The center electrode 4 is disposed on the plug center axis M so as to extend along the plug center axis M. A discharging part 41 made of a noble metal chip is disposed on the distal end of the center electrode 4.

The plug cover 6 is fixed to the distal end of the housing 2 so as to cover the center electrode 4. Accordingly, the ground electrode 5 and the discharging part 41 of the center electrode 4 axially oppose to each other on the plug center axis M. The spark discharge gap 11 is formed between an electrode-opposing surface 51 of the ground electrode 5 and the discharging part 41 of the center electrode 4, the electrode-opposing surface 51 being opposed to the discharging part 41.

Figure 3:
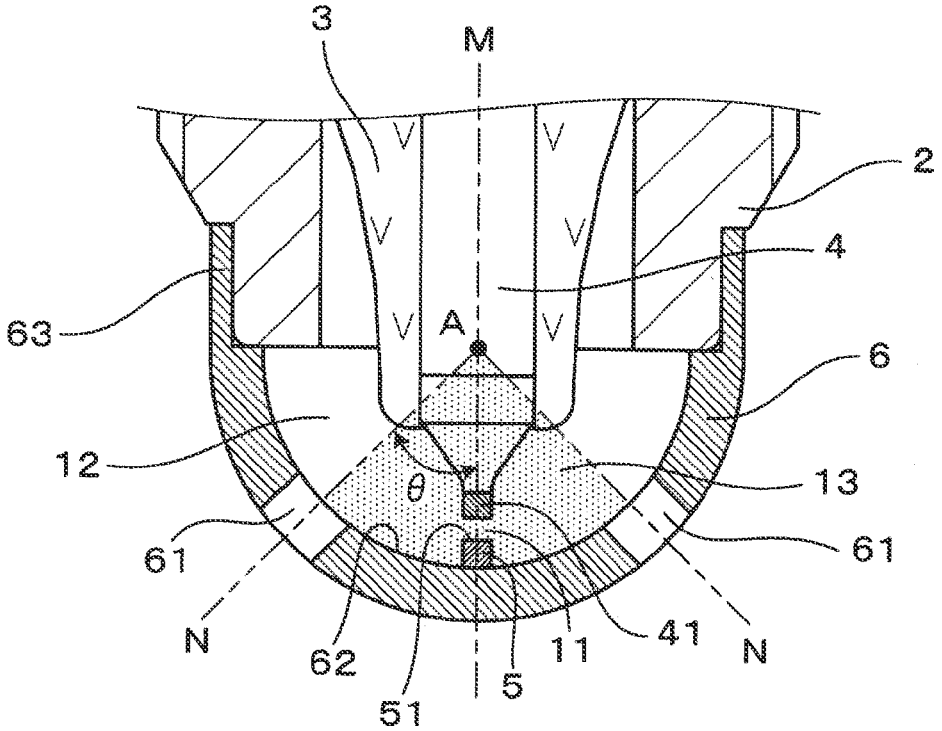
FIG. 3 is a diagram for explaining a distal space area of the spark plug according to the first embodiment of the invention.
Figure 4:
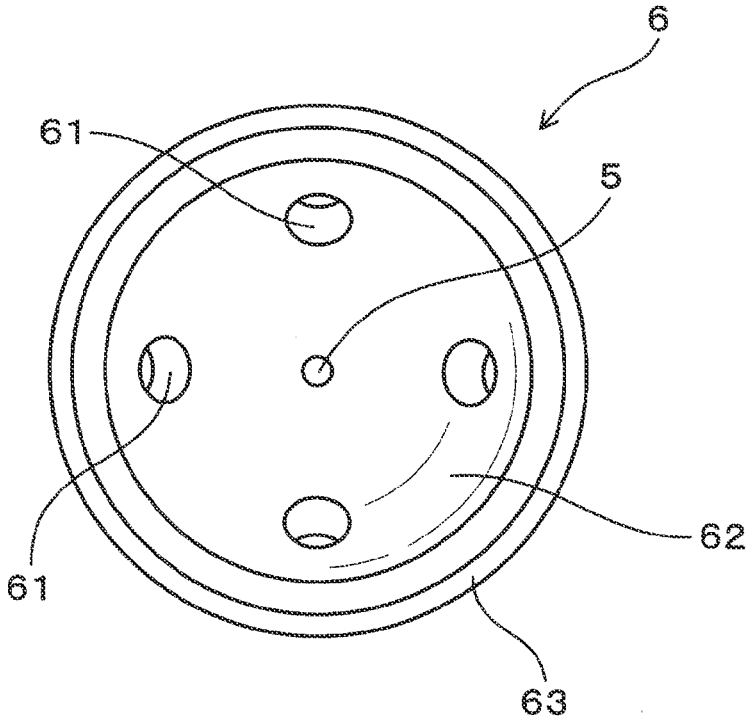
FIG. 4 is a plan view of a plug cover of the spark plug according to the first embodiment of the invention as viewed from the proximal side.

As shown in FIGS. 2 and 4, the plug cover 6 is formed with a plurality of the through holes 61. The through holes 61 are located at positions radially shifted from the plug center axis. As shown in FIG. 3, the center line N of each distal-side through hole 61 (the through hole 61 on the distal most side) is inclined to the plug center line M such that it approaches the plug center line M toward the proximal side. In this embodiment, as shown in FIG. 4, the through holes 61 are formed at four positions. The locations of the four through holes 61 are the same in the axial position. That is, in this embodiment, each of the through holes 61 is a distal-side through hole the center line N of which is inclined to the plug center line M such that it approaches the plug center line M toward the proximal side.

As shown in FIG. 3, the electrode-opposing surface 51 opposed to the center electrode 4 is located within a distal space area 13 surrounded by a conical plane obtained by rotating the center line N of the distal-side through hole 61 around the plug center axis M and the inner surface 62 of the plug cover 6 on the more distal side than the conical plane is. In this embodiment, since the ground electrode 5 is located on the plug center line M, the electrode-opposing surface 51 is located at a point on the more distal side than the intersection point A between the center line N and the plug center axis M within the auxiliary combustion chamber 12.

In this embodiment, the center electrode 4 projects to the distal side beyond the distal end of the housing 2 and the distal end of the insulator 3, and the distal end of the insulator 3 projects to the distal side beyond the distal end of the housing 2. The plug cover 6 is made of a conductive material such as a nickel based alloy. Accordingly, the ground electrode 5 provided in the plug cover 6 is in electrical contact with the housing 2 to be grounded. The four through holes 6 formed in the plug cover 6 are evenly spaced in the circumferential direction.

The spark plug 1 according to the first embodiment of the invention described above provides the following advantages. The ground electrode 5 is disposed projecting from the inner surface 62 of the plug cover 62 toward the auxiliary combustion chamber 12. Accordingly, it is possible to reduce or eliminate an area in which the ground electrode 5 is interposed with the spark discharge gap 11 within the auxiliary combustion chamber 12. This makes it possible for a flame produced in the spark discharge gap 11 to grow in the auxiliary combustion chamber 12 without being inhibited by the ground electrode 5. Therefore, good combustion in the auxiliary combustion chamber 12 is achieved, and good flame jet injection from the through holes 61 to the combustion chamber of the internal combustion engine is achieved. Hence, according to this embodiment, the combustibility of an internal combustion engine can be improved.

As shown in FIG. 3, since the electrode-opposing surface 51 of the ground electrode 5 is located within the distal space area 13, it is possible to efficiently ignite an air-fuel mixture introduced to the auxiliary combustion chamber 12 through the through holes 62. That is, the air-fuel mixture introduced into the auxiliary combustion chamber 12 through the through holes 62 spreads in the auxiliary combustion chamber 12 in a radial pattern with the center line N being its center. At this time, since the distal side of the auxiliary combustion chamber 12 is covered by the plug cover 6, the air-fuel mixture is likely to accumulate early in an area on the more distal side than the center line N. That is, the air-fuel mixture is likely to accumulate early particularly within the distal space area 13 n the auxiliary combustion chamber 12. Hence, by locating the electrode-opposing surface 51 of the ground electrode 5 within the distal space area 13, ignition can be made early. In addition, by locating the electrode-opposing surface 51 of the ground electrode 5 within the distal space area 13, a flame jet can be injected early to the combustion chamber the internal combustion engine disposed outside the plug cover 6 through the through holes 61 when a flame kernel has grown in the auxiliary combustion chamber 12. As a result, the combustibility of the internal combustion engine can be improved.

Second Embodiment

Figure 5:
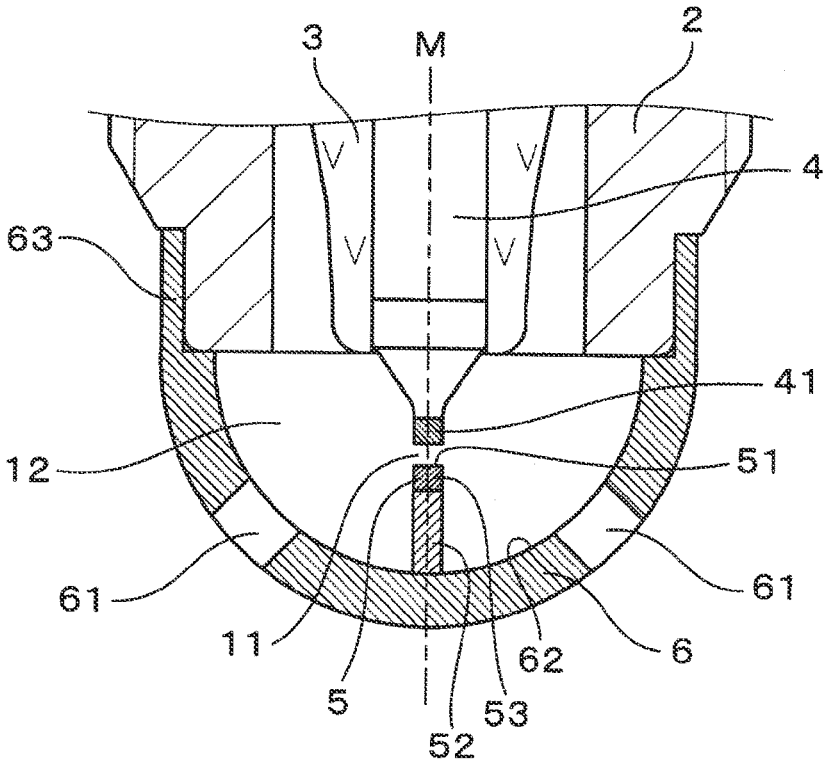
FIG. 5 is a cross-sectional view of a distal end portion of a spark plug according to a second embodiment of the invention.

Next, a second embodiment of the invention is described with reference to FIG. 5. As shown in FIG. 5, in the second embodiment, the amount of projection of the ground electrode 5 from the inner surface 62 of the plug cover 6 is more than that in the first embodiment. In the second embodiment, the position of the electrode-opposing surface 51 of the ground electrode 5 is shifted to the housing 2 compared to the first embodiment. On the other hand, the discharging part 41 of the center electrode 4 is shifted to the proximal side instead.

In this embodiment, the ground electrode 5 is constituted of a standing part 52 standing from the inner surface 62 of the plug cover 6 to the proximal side, and a discharging part 53 joined to the proximal end surface of the standing part 52. The discharging part 53 is made of a noble metal chip whose proximal end surface makes the electrode-opposing surface 51. The standing part 52 is made of a metal material such as a nickel based alloy.

In this embodiment, the position of the electrode-opposing surface 51 of the ground electrode 5 can be adjusted to an optimum position by adjusting the length of the standing portion 53. Other than the above, the second embodiment provides the same advantages as those provided by the first embodiment.

Third Embodiment

Figure 6:
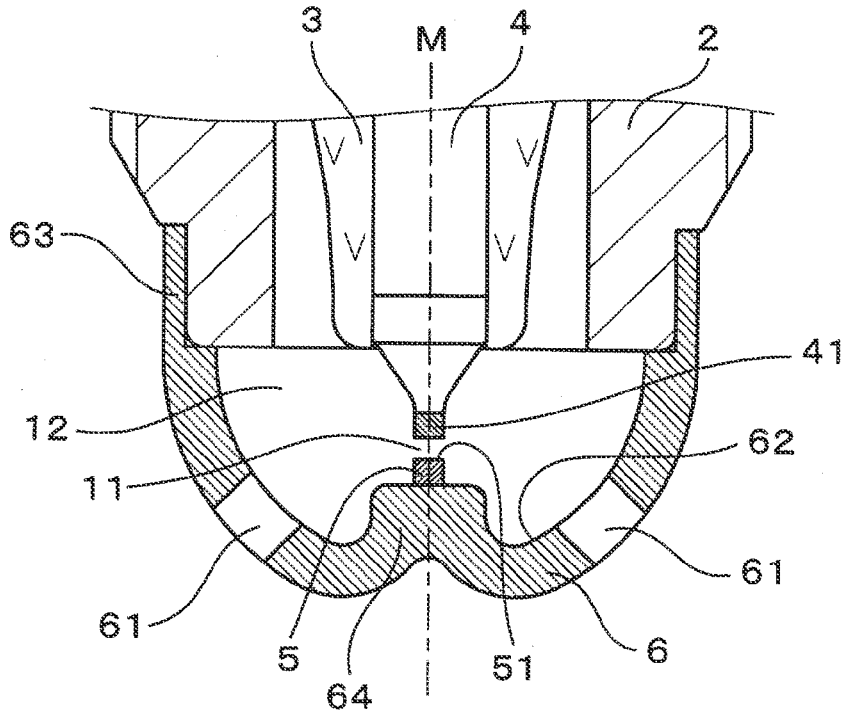
FIG. 6 is a cross-sectional view of a distal end portion of a spark plug according to a third embodiment of the invention.

Next, a third embodiment of the invention is described with reference to FIG. 6. As shown in FIG. 6, in the third embodiment, the plug cover 6 is formed with a center bump part 64 at its center portion, the center bump part 64 protruding to the proximal side. The center bump part 64 is joined to the ground electrode 5. The ground electrode 5 projects from the center bump part 64 to the proximal side.

In the third embodiment, the axial position of the ground electrode 5 can be adjusted easily by deforming the center bump part 64. For example, by adjusting the level of protrusion of the center bump part 64 after the plug cover 6 is fitted, it is possible to adjust the position of the electrode-opposing surface 51 of the ground electrode 5 and adjust the size of the spark discharge gap 11 with the discharging part 41 of the center electrode 4. Other than the above, the third embodiment provides the same advantages as those provided by the first embodiment.

Fourth Embodiment

Figure 7:
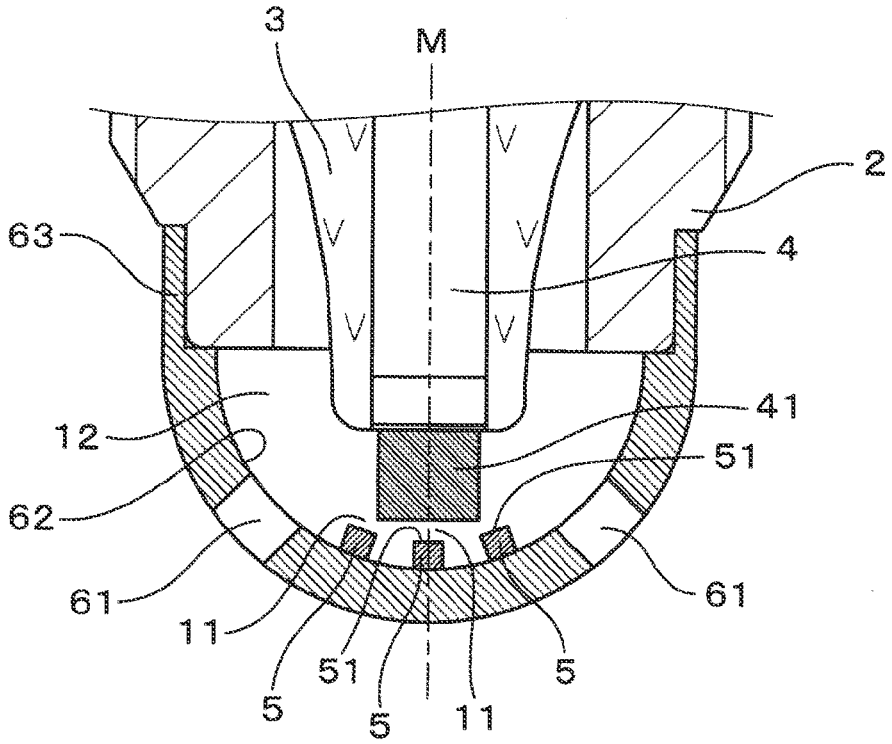
FIG. 7 is a cross-sectional view of a distal end portion of a spark plug according to a fourth embodiment of the invention.

Next, a fourth embodiment of the invention is described with reference to FIG. 7. The fourth embodiment includes a plurality of the ground electrodes 5. The plurality of the ground electrodes 5 are formed projecting from the inner surface 62 of the plug cover 6. One of the ground electrodes 5 is disposed on the plug center axis M, and the other ground electrodes 5 are disposed around it.

The diameter of the discharging part 41 of the center electrode 4 of this embodiment is larger than that of the first embodiment. The electrode-opposing surface 51 of each of the ground electrodes 5 is opposed to the discharging part 41 of the center electrode 4.

According to the fourth embodiment, since the spark discharge gap 11 is formed at a plurality of different positions, the ignitability can be further improved. Other than the above, the fourth embodiment provides the same advantages as those provided by the first embodiment.

Fifth Embodiment

Figure 8:
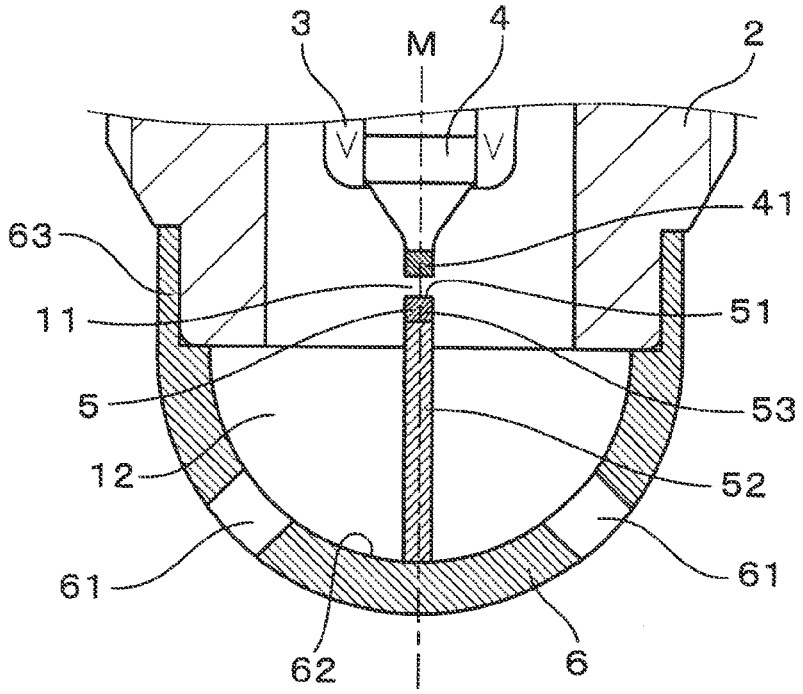
FIG. 8 is a cross-sectional view of a distal end portion of a spark plug according to a fifth embodiment of the invention.

Next, a fifth embodiment of the invention is described with reference to FIG. 8. In the fifth embodiment, the spark discharge gap 11 is disposed on the more proximal side than the distal end of the housing 2. That is, in the fifth embodiment, the spark discharge gap 11 is located inside the housing 2. The discharging part 41 of the center electrode 4 recedes to the proximal side beyond the distal end of the housing 2. The ground electrode 5 extends from the inner surface 62 of the plug cover 6 to the proximal side beyond the distal end of the housing 2. In this embodiment, the ground electrode 5 is constituted of the standing part 52 and the discharging part 53 like in the second embodiment.

In this embodiment, the electrode-opposing surface 51 of the ground electrode 5 is disposed outside the distal space area 13 unlike in the first embodiment. Other than the above, the fifth embodiment is the same in structure as the first embodiment.

Next, results of a test performed on examples of the spark plug basically according to the first embodiment of the invention are explained with reference to FIG. 9. In this test, a relationship between the axial position of the electrode-opposing surface 51 of the ground electrode 5 and a limit A/F of the spark plug was measured. The term "limit A/F" means a limit air-fuel ratio below which the spark plug can maintain normal combustion. Accordingly, the ignitibility increases with the increase of the limit A/F. Here, the term "normal combustion" means combustion where the combustion variation is less than 5%.

For this test, five kinds of the spark plugs were prepared as spark plugs L1 to L5. The diameter D of the through hole 61, the angle theta formed by the center line N of the through hole 61 and the plug center axis M of each of them are shown in the following table. For each of the spark plugs L1 to L5, a plurality of samples which are different in the axial position of the electrode-opposing surface 51 of the ground electrode 5 were prepared. The structures of the spark plugs L1 to L5 are basically the same as the spark plug according to the first embodiment described above. However, to differentiate the axial positions of their electrode-opposing surfaces 51, some of them included the standing part 52, and the length of the standing portion 51 was adjusted differently.

TABLE

| SAMPLE | D[mm] | θ [degree] |
|---|---|---|
| L1 | 1.4 | 45 |
| L2 | 1.2 | 45 |
| L3 | 1.6 | 45 |
| L4 | 1.4 | 30 |
| L5 | 1.4 | 60 |

The common features of the spark plugs L1 to L5 areas follows. The diameter of the housing 2 is 9 mm. The radius of the inner surface 6 of the plug cover 6 is 4.0 mm. The thickness of the plug cover 6 is 1.0 mm. The through hole 61 is circular when viewed in the direction of the center line N.

The discharging part 41 of the center electrode 4 has a columnar shape with its diameter being 0.55 mm. The ground electrode 5 (discharging part 53) has an columnar shape, with its diameter being 0.7 mm. The discharging part 41 of the center electrode 4 is made of 90 wt % Ir-10 wt % Rh, and the ground electrode 5 (discharging part 53) is made of 90 wt % Pt-10 wt % Rh.

Each of these spark plugs L1 to L5 were mounted on a test chamber simulating a 1800 cc gasoline engine, and combustion state was monitored under the conditions of the revolution speed being 1,500 rpm and the rotation torque being 35 Nm to measure the limit A/F. The test results are shown in the graph of FIG. 9.

The position of the electrode-opposing surface 51, which is represented by the horizontal axis of this gap, is the axial distance from the intersection point A (the intersection point between the center line N and the plug center axis M). When the position of the electrode-opposing surface 51 is on the more distal side than the intersection A, it is given the positive sign. When the position of the electrode-opposing surface 51 is on the more proximal side than the intersection A, it is given the negative sign.

Figure 9:
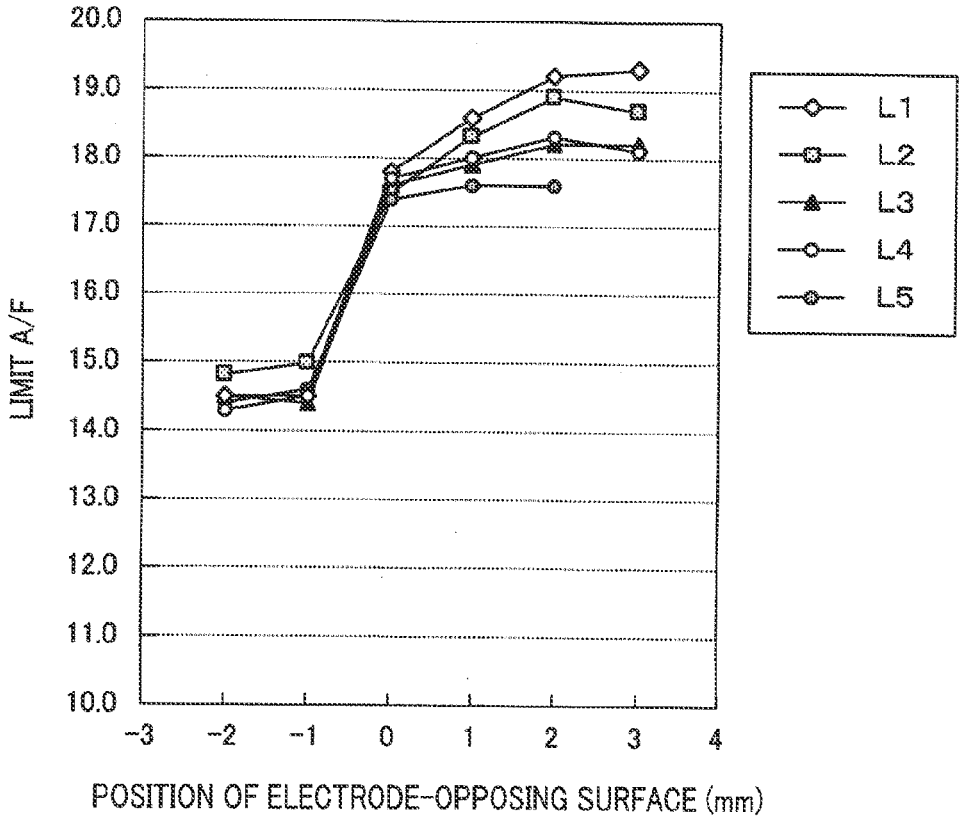
FIG. 9 is a graph showing test results of examples of the spark plug according to the first embodiment of the invention.

As seen from the graph of FIG. 9, the limit A/F increases rapidly when the position of the electrode-opposing surface 51 of the ground electrode 5 exceeds 0 mm irrespective of the diameter D and the angle theta of the through hole 61 for all the spark plugs L1 to L5. That is, when the position of the electrode-opposing surface 51 of the ground electrode 5 is on the more distal side than the intersection point A, the spark plug 1 exhibits excellent ignitability. Hence, it was confirmed that locating the electrode-opposing surface 51 within the distal space area (see FIG. 3) enables increasing the ignitability.

Incidentally, the ground electrode 5 is disposed on the plug center axis M in the above embodiments, however, it may be disposed at a position shifted from the plug center axis M. Further, the positions of the through holes 61 are the same in axial position, they may be formed at different axial positions.

The above explained preferred embodiments are exemplary of the invention of the present application which is described solely by the claims appended below. It should be understood that modifications of the preferred embodiments may be made as would occur to one of skill in the art.

What is claimed is:

1. A spark plug for an internal combustion engine comprising:

a tubular housing;

a tubular insulator held inside the housing;

a center electrode held inside the insulator;

a ground electrode disposed so as to form a spark discharge gap with the center electrode; and a plug cover fixed to a distal end portion of the housing so as to form an auxiliary combustion chamber with the housing; wherein:

the plug cover is formed with at least one through hole for communicating between inside of the auxiliary chamber and outside of the plug cover;

the ground electrode is formed so as to project from an inner surface of the plug cover toward the inside of the auxiliary combustion chamber;

when one of the through holes which is located on a most distal side of the spark plug is referred to as a distal-side through hole, a center line of the distal-side through hole approaches a plug center axis of the spark plug toward a proximal side of the spark plug, and the ground electrode includes an opposing surface opposed to the center electrode, the opposing surface being located within a distal space area surrounded by a conical plane obtained by rotating the center line of the distal-side through hole around the plug center axis and by the inner surface of the plug cover located on a more distal side of the spark plug than the conical plane.

* * * * *